US006707262B2

(12) United States Patent
Busse et al.

(10) Patent No.: US 6,707,262 B2
(45) Date of Patent: Mar. 16, 2004

(54) DISCHARGE LAMP OPERATING CIRCUIT HAVING A CIRCUIT FOR DETECTING THE PROXIMITY TO CAPACITIVE OPERATION

(75) Inventors: Olaf Busse, Munich (DE); Markus Heckmann, Munich (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 10/457,427

(22) Filed: Jun. 10, 2003

(65) Prior Publication Data

US 2003/0227264 A1 Dec. 11, 2003

(30) Foreign Application Priority Data

Jun. 11, 2002 (DE) ..... 102 25 881

(51) Int. Cl.[7] ..... H05B 37/02

(52) U.S. Cl. ..... 315/224; 315/244; 315/307; 315/291; 315/209 R; 315/DIG. 5

(58) Field of Search ..... 315/224, 194, 315/200 R, 209 R, 247, 244, 291, 307, 360, 362, DIG. 5, DIG. 7, 119

(56) References Cited

U.S. PATENT DOCUMENTS

| | | | | |
|---|---|---|---|---|
| 4,928,038 A | * | 5/1990 | Nerone | 315/209 R |
| 5,914,572 A | * | 6/1999 | Qian et al. | 315/307 |
| 6,331,755 B1 | | 12/2001 | Ribarich et al. | 315/225 |
| 6,400,095 B1 | * | 6/2002 | Primisser et al. | 315/224 |

* cited by examiner

*Primary Examiner*—Haissa Philogene

(57) ABSTRACT

The invention relates to an operating circuit for a discharge lamp, having a detection circuit for identifying the proximity to capacitive operation, which uses lamp current fluctuations for detection purposes.

13 Claims, 2 Drawing Sheets

DISCHARGE LAMP OPERATING CIRCUIT HAVING A CIRCUIT FOR DETECTING THE PROXIMITY TO CAPACITIVE OPERATION

TECHNICAL FIELD

The invention relates to an operating circuit for discharge lamps.

It relates here to operating circuits which supply the discharge lamp with radio-frequency supply power which is obtained from a supply power via an oscillator circuit. In particular, although not exclusively, the invention relates to the case in which the supply power for the oscillator circuit is obtained from an a.c. voltage supply power which is rectified. Operating circuits of this kind are in general use, in particular for low-pressure discharge lamps, and therefore need not be explained in detail.

BACKGROUND ART

The oscillator circuit in this case supplies what is known as a load circuit, into which the discharge lamp is connected, and through which a radio-frequency lamp current, generated by the oscillator circuit, flows. The load circuit defines in this case a resonant frequency which is influenced by various electrical parameters of the load circuit and is also dependent on, among other things, the operating state of the discharge lamp. The aim is to operate the load circuit relatively close to the resonant frequency during continuous operation of the discharge lamp. This has the advantage of small phase shifts between the current and voltage, and thus small reactive currents. This is of benefit when dimensioning components, in particular of a lamp inductor. Otherwise, the oscillator circuit which generates the radio-frequency supply power generally contains switching elements. When phase shifts are small due to operation close to resonance, the switching losses in the switching elements are relatively low. This has advantages with regard to the efficiency of the operating circuit as well as to the thermal load and the dimensioning of the switching elements.

The aim is normally to operate in what is known as the inductive region, i.e. at an operating frequency of the oscillator circuit which is greater than the resonant frequency of the load circuit. This does, however, require that the operating frequency of the oscillator circuit be prevented from falling below the resonant frequency, since, in capacitive operation, i.e. when the operating frequency is less than the resonant frequency, disturbing current spikes can be produced in the switching elements, or other problems may result. It is particularly possible in capacitive operation, due to the switching times and the lamp inductor current being incorrectly synchronized, for a pronounced positive current spike to be produced at the beginning of a lamp current half-cycle that is carried by a switching element. It is therefore aimed, on the whole, to operate as close as possible to the resonant frequency, but the frequency should not, if possible, fall below the resonant frequency, or should only fall below it to a limited extent.

However, fluctuations in the lamp impedance (based on continuous operation) occur as a result of temperature changes and aging processes such as electrode wear, mercury diffusion in fluorescent substances and other aging phenomena as well as scatter between the individual examples of different individual discharge lamps.

These lamp impedance fluctuations and the usual component tolerances mean that the operating circuits cannot easily be set relatively accurately to operation close to resonance. On the contrary, for reasons of safety, a relatively large margin is maintained from the nominal resonant frequency in order to take into account the fluctuations and tolerances mentioned. This results in increased component costs and increased space requirement due to the correspondingly larger dimensioning as well as in losses in efficiency.

Attempts have therefore already been made to equip operating circuits of the described construction with detection circuits for identifying the proximity to capacitive operation of the load circuit. For example, FIG. 5 of U.S. Pat. No. 6,331,755 shows a resistor RCS for measuring a lamp inductor current and a comparator COMP for comparing this inductor current with a threshold value. The comparison is carried out on a switching-off flank of a switching transistor in a half-bridge oscillator circuit. The closer the operating frequency comes to the resonant frequency, and therefore to capacitive operation, not only the smaller is a switching-on peak of the measurement voltage (at which the mathematical sign is reversed) across the resistor RCS, but also the more the measurement voltage falls at the end of the time for which said switching transistor is switched on. It is therefore possible to use the threshold value to set a limit state in which the circuit is completely switched off (shown on the right-hand side of FIG. 6 of that document) if operation becomes too close to resonance.

DESCLOSURE OF THE INVENTION

Against the background of the cited prior art, the technical problem on which the invention is based is to further improve an operating circuit for a discharge lamp having an oscillator circuit and a detection circuit for identifying the proximity to capacitive operation of the load circuit.

The invention relates to an operating circuit of the type described, in which the detection circuit detects the magnitude of fluctuations, corresponding to the changes in supply power, in the lamp current or in a manipulated variable of a lamp control circuit.

Preferred embodiments are given in the dependent claims.

The invention is characterized by the detection circuit identifying the proximity to capacitive operation in a particularly advantageous form. For this purpose, in a variant of the invention the detection circuit detects, the magnitude of fluctuations, corresponding to the frequency of the supply power, in the lamp current. If the oscillator circuit is supplied with a rectified a.c. voltage supply power, the supply power of the oscillator circuit fluctuates with the fluctuations, resulting from the a.c. voltage frequency, in the rectified supply voltage (what is known as the intermediate circuit voltage). The intermediate circuit voltage is therefore modulated at twice the frequency of the original a.c. voltage. It is the rectification process which causes the frequency to be doubled. It is theoretically also conceivable for no frequency doubling to occur here; in any case, the modulation of the intermediate circuit voltage is related to the frequency of the original a.c. voltage.

This intermediate circuit voltage modulation can generally still be measured in the lamp current itself, specifically even if the lamp current is determined by means of a current or power control circuit, which constitutes a preferred embodiment of the invention. Control circuits, depending on the technical complexity, are capable of attenuating this modulation only to a limited extent. If no control circuit is provided, it is even easier for the modulation of the intermediate circuit voltage to be identified in the lamp current.

Moreover, this also applies to the case, which likewise represents a preferred embodiment of the invention, in which the rectified a.c. voltage supply power is converted to a substantially constant d.c. voltage by means of a PFC (Power Factor Correction) circuit. The PFC circuit is used to limit the harmonic content of the power consumption from the a.c. voltage network and generally charges a storage capacitor to the intermediate circuit d.c. voltage. The intermediate circuit voltage is then also modulated, to a certain extent, in accordance with the a.c. voltage frequency.

The magnitude of the lamp current fluctuations depends on the proximity to the resonant frequency and thus on the proximity to capacitive operation. This follows from the increase in the lamp current with increasing proximity to resonance, on the one hand, and from the modulation of the proximity to resonance by the intermediate circuit voltage modulation, on the other hand.

The magnitude of the fluctuations in the lamp current is thus a particularly simple way of detecting the proximity to capacitive operation. Of particular concern here is a signal which varies, for example, at twice the mains frequency of the a.c. voltage network and which to this extent does not represent any substantial difficulties in terms of measurement. On the other hand, the conventional solutions for detecting the proximity to capacitive operation are linked to the operating frequency of the oscillator circuit itself and must be referred to these phases, which requires a considerably greater degree of circuitry complexity. The lamp current must in many cases be measured for other reasons anyway, for example in order not to exceed certain maximum values for safety considerations or in order to carry out the current regulation mentioned above. The invention is thus associated with even less additional outlay.

In the general description of the invention in claim 1 and claim 2, mention is made of a variable supply power. As mentioned above, this may, on the one hand, be a rectified a.c. voltage supply power. The invention does, however, also include the case in which the operating circuit is operated using a d.c. voltage source. In this case, there is no need for a rectifier, or any rectifier which is provided in any case has no effect. In this case too, however, it may also be desirable to use the invention. For this purpose, the d.c. voltage or intermediate circuit voltage may be modulated in a deliberate manner. In addition to the possibility of detection, according to the invention, of the proximity to capacitive operation of the load circuit, this also has the advantage that, as a result of the modulation, the frequency spectrum of radio-frequency interference, which is transmitted through the operating circuit to the d.c. voltage source, is broadened. The interference is thus less problematic since it occurs over a wider, and therefore flatter, interference spectrum. The variable supply powers, for the purposes of the claims, may therefore also be d.c. voltage supply powers which have been modulated in a deliberate manner. The invention particularly also relates to combination operating circuits which are provided for operation from both d.c. voltage and a.c. voltage sources.

As an alternative to detecting the magnitude of the fluctuations in the lamp current itself, the invention also aims at the case where the lamp current is determined by a control circuit for controlling the load circuit, i.e. in particular the lamp current or the lamp power, in which case a manipulated variable is detected for the control circuit, i.e. the changes in the control circuit when the control circuit is attempting to keep the controlled variable constant. The manipulated variable could then be regarded as an image of the lamp current fluctuations, even if the lamp current fluctuations are not occurring, or occurring only to a limited extent.

The control circuit preferably has an I control element, i.e. an integrating element, in order to compensate for the comparatively slow parameter changes in the discharge lamp in terms of the described changes in impedance due to aging or other long-term fluctuations. In many cases, such an I control element will be sufficient. If required, it may be supplemented by a P control element (proportional element) or by some other additional device in order to take better account of the intermediate circuit voltage modulation.

In particular, the control circuit and other means of controlling the oscillator circuit may be provided by means of an integrated digital circuit which has to have only a few additional functions. Furthermore, the digital circuit may be a programmable circuit or what is known as a microcontroller, in which case the additional complexity required for the invention may be limited just to additional software.

Such a digital control circuit or such a microcontroller may, in particular, in addition to controlling the oscillator circuit, also adopt the function of controlling the PFC circuit mentioned.

It is preferably also provided for the operating circuit not to be switched off when specific proximity to capacitive operation is identified, as is the case in the prior art, but for its operation to be continued, at least normally. Identification of the proximity to capacitive operation should therefore result in the method of operation being influenced such that this proximity is at least increased no further or is even reduced, making it possible to continue operation. For example, the operating frequency of the oscillator circuit could be directly influenced. The preferred solution for the case of a control circuit is, however, to reduce the desired current value or the desired power value of the current control circuit, which may cause the frequency to be indirectly influenced. To clarify, the operating circuit according to the invention is thus designed not to come too close to capacitive operation during continuous operation and to prevent it getting any closer to capacitive operation if it is already too close, but with lamp operation continuing. For this purpose, it is acceptable, in particular, to change parameters which may have been predetermined in a fixed manner, such as the operating frequency or the lamp current, if necessary. Specifically, from the point of view of the invention, it would be more acceptable for the discharge lamp to dim slightly in situations such as this than to be switched off entirely.

It may be provided, in particular, for the detection circuit to compare the magnitude of the fluctuations with a predetermined threshold value and, as long as the threshold value is not exceeded, to influence operation no further. If the threshold value is exceeded, the detection circuit may either continuously vary the operating frequency, the desired control value or another variable in accordance with a control context, or else vary it by a predetermined fixed amount, as illustrated in the exemplary embodiment. In any case, the comparison with the threshold value preferably results in a detection circuit function which does not normally influence operation.

BRIEF DESCRIPTION OF THE DRAWINGS

The invention will be described in more detail below with reference to an exemplary embodiment, it being possible for the features represented in this case to be significant to the invention in other combinations as well. It should be mentioned, in particular, that the description above and below should also be understood in terms of its method.

BEST MODE FOR CARRYING OUT THE INVENTION

Figure 1:
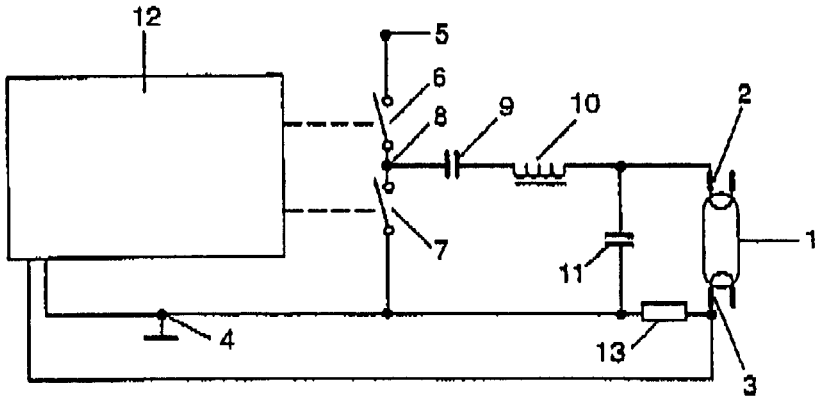
FIG. 1 shows a schematic representation of operating equipment according to the invention.

In FIG. 1, reference numeral 1 denotes a low-pressure discharge lamp having two incandescent filament electrodes 2 and 3. A half-bridge oscillator circuit, known per se and having two switching transistors 6 and 7, is situated between a ground connection 4 and an intermediate circuit supply voltage 5. A center tap 8 may be switched between the intermediate circuit supply voltage and the ground potential by alternately switching the two switching transistors 6 and 7. This enables a radio-frequency supply voltage for the discharge lamp 1 to be produced from the rectified intermediate circuit supply voltage, which is applied to the connection 5 and is obtained from a mains voltage via a rectifier bridge circuit, known per se, having a PFC circuit.

The PFC circuit, which is not illustrated in FIG. 1, may be what is known as a step-up converter, which has a construction which is known per se, the details of this step-up converter not being essential to the invention. It may also be another type of PFC circuit. Despite the PFC circuit, there is, however, a certain amount of residual modulation on the intermediate circuit voltage at twice the mains frequency, i.e. usually at 100 Hz.

Connected in series between the ground connection 4 and the center tap 8 are what is known as a coupling capacitor 9, a lamp inductor 10 and the discharge lamp 1. The coupling capacitor 9 is used for decoupling the discharge lamp 1 from d.c. components; the lamp inductor 10 is used in particular for compensating for the derivation, which is in some cases negative, of the current-voltage characteristic of the discharge lamp 1. The two circuit components are generally known to have these functions and need not be explained in more detail here.

The same applies to a resonance capacitor 11 which is connected in parallel with the discharge lamp 1 and likewise in series with the coupling capacitor 9 and the lamp inductor 10, and is used for producing starting voltage amplitudes, increased by resonance, for the purpose of starting the discharge lamp 1.

According to the description so far, the operating circuit is of entirely conventional construction. However, the control connections of the switching transistors 6 and 7, as indicated by dashed lines in FIG. 1, are controlled by control signals from a digital control circuit 12. The digital control circuit 12 is a programmable microcontroller and detects, via a measurement shunt 13, a signal indicating the magnitude of the current through the lamp inductor 10.

The control circuit 12 contains, in particular, a current control circuit which controls the lamp current tapped off via the resistor 13 to a substantially constant value $I_{lamp}$. The method of operation of the control circuit 12 is illustrated in more detail in FIG. 3.

The control circuit 12 can therefore measure the lamp current $I_{lamp}$ by means of the measurement shunt 13, and also uses the operating frequency of the half-bridge oscillator having the switching transistors 6 and 7 to control it to a constant lamp current, and, finally, is capable, by evaluating the remaining modulation of the lamp current amplitude resulting from the modulation of the intermediate circuit voltage, of identifying operation which is too close to capacitive operation. For this purpose, as illustrated with reference to FIG. 3, a threshold value is used for the difference, illustrated in FIGS. 2*a* and 2*b*, between the lamp current amplitude maximum $I_{max}$ and lamp current amplitude minimum $I_{min}$.

Figure 2A:
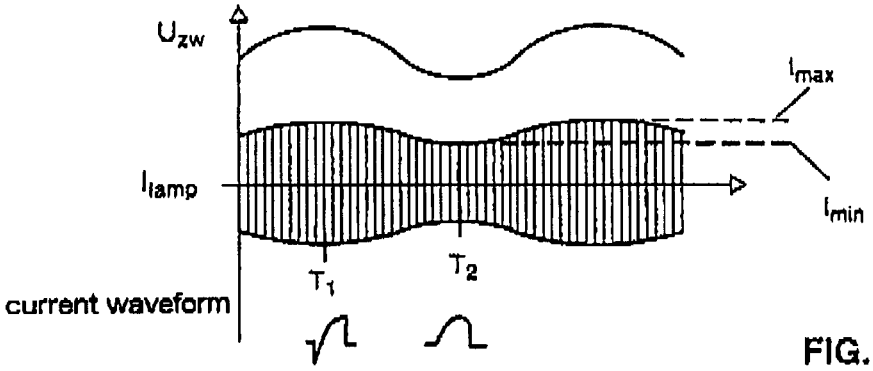
FIG. 2*a* shows, schematically, the relationship between intermediate circuit voltage, the discharge lamp current and the qualitative current waveform in switching elements of an oscillator circuit in an operating circuit according to the invention.
Figure 2B:
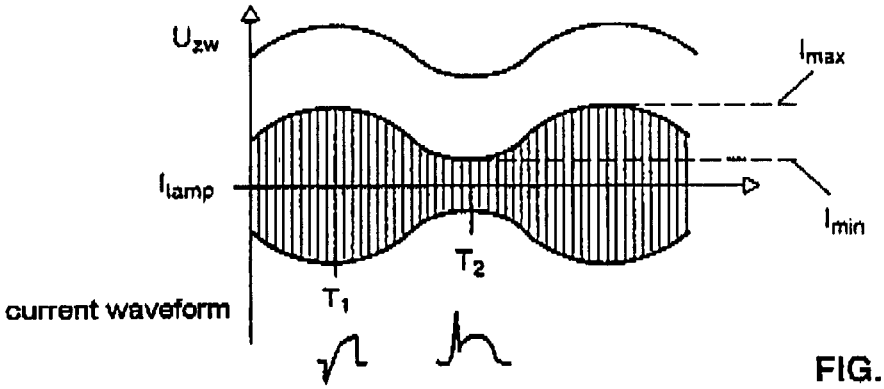
FIG. 2*b* corresponds to FIG. 2*a*, but relates to an operating state closer to resonance.

FIGS. 2*a* and 2*b* show schematic representations of the qualitative form of the fluctuations mentioned for an operating state, as illustrated in FIG. 2*a*, which is close to resonance but is advantageous, and for an operating state, as illustrated in FIG. 2*b*, which is disadvantageous. This shows the change in the magnitude of the fluctuations in the lamp current $I_{lamp}$ tapped off across the shunt 13 and the corresponding changes in the intermediate circuit voltage $U_{ZW}$ present between point 5 and the ground connection 4. The lamp current is shown with its envelope which illustrates the fluctuations in the amplitude with the intermediate circuit voltage $U_{ZW}$. The lamp current $I_{lamp}$ actually oscillates at the operating frequency of the half-bridge oscillator circuit, as is indicated only schematically in FIGS. 2*a* and 2*b*.

The lower region of each of the figures shows qualitative current waveforms of the half-cycle currents flowing through the in each case closed switching transistor 6 or 7. The limited negative deflection which can initially be seen in each of the left-hand current waveforms is typical for inductive operation and means that the current lags the voltage. As long as the negative peak is not too pronounced, this may be regarded as an advantageous operating state. The right-hand current waveform in FIG. 2*a* shows that, in the region of the small amplitudes of the lamp current, i.e. of the minimum intermediate circuit voltages $U_{ZW}$, the negative deflection indicating inductive operation has almost disappeared. The proximity to capacitive operation therefore fluctuates with the intermediate circuit voltage $U_{ZW}$. The right-hand current waveform in FIG. 2*b* accordingly shows a pronounced positive peak at the beginning of the current waveform which symbolizes the onset of capacitive operation. This peak leads to thermal loads and possibly damage to the switching transistors 6 and 7, and should be avoided.

Figure 3:
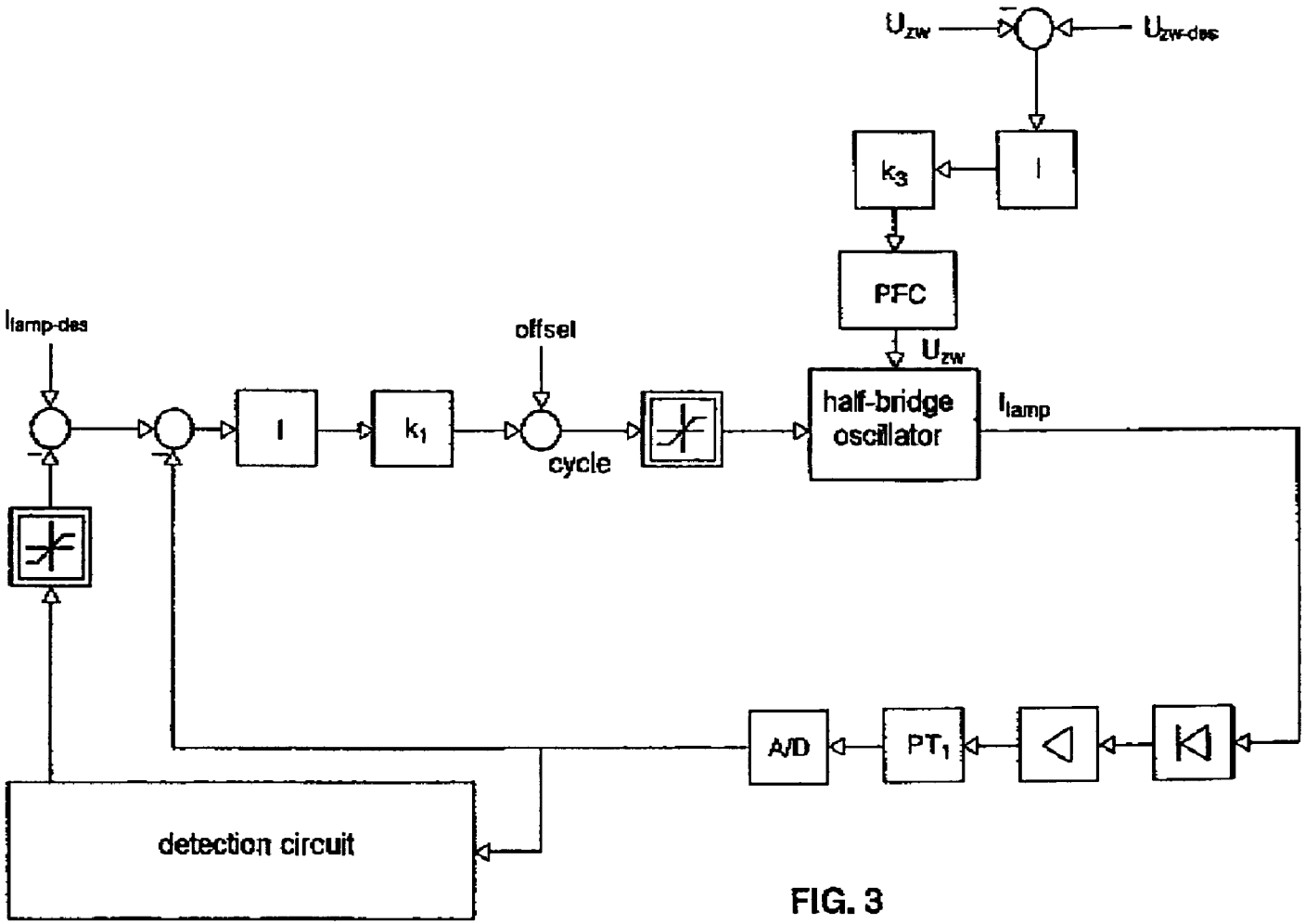
FIG. 3 shows a block diagram of a program sequence in a control circuit of the operating circuit shown in FIG. 1.

FIG. 3 shows, in the form of a block diagram, the method of operation of the operating circuit in FIG. 1. The sequence illustrated is run as software stored in the microcontroller 12. According to the upper end of the block diagram, a measured intermediate circuit voltage (between points 4 and 5 in FIG. 1) $U_{ZW}$ is subtracted from a desired intermediate voltage value $U_{ZW\text{-}des}$. The difference is integrated using an integration element denoted by I, multiplied by a normalization constant designated by $k_3$ and used to control the PFC circuit, not shown in FIG. 1, to a constant output voltage. For this purpose, the switching operations of a switching transistor in the PFC circuit, for example a step-up converter, are correspondingly clocked, i.e. the operating frequency of the switching transistor is finally varied such that the output voltage, and thus the intermediate circuit voltage $U_{ZW}$, is as constant as possible. This intermediate circuit voltage is output by the PFC circuit via points 4 and 5 in FIG. 1 to the half-bridge oscillator, formed by the switching transistors 6 and 7, and the load circuit containing the lamp 1.

The half-bridge oscillator having the switching transistors 6 and 7 produces the lamp current $I_{lamp}$ flowing through the lamp 1 which is measured across the measurement shunt 13 by the microcontroller 12. This is symbolized by the arrow pointing to the right from the half-bridge oscillator in FIG. 3. The lamp current is rectified and amplified in the microcontroller by the elements designated by the appropriate electrical engineering circuit symbols and then filtered in a low-pass element, designated by $PT_1$, for the purpose of averaging, and finally AD-converted.

The circuit then branches off, leading on the one hand to a block designated as the detection circuit. This detection circuit calculates, over a time period of 10 ms, the fluctuations in the lamp current amplitude, i.e. the difference between the maximum and minimum of the lamp current amplitude or the envelope within said time period. If this difference exceeds a value of 50 mA, for example, the detection circuit increases its output signal, otherwise it decreases it. The detection circuit is therefore based on the principle that no output signal is normally required and in this normal case has the output signal 0 (which is also not decreased further). If the threshold value of 50 mA is exceeded, the output signal is increased by a specific fixed value and once the 10 ms time period has elapsed, is increased again by this fixed amount as long as the 50 mA threshold value is being exceeded.

As soon as the threshold value is no longer being exceeded, the output signal is decreased in steps, it being preferable for smaller steps to be used than when increasing the signal value. This takes place until an output signal of 0, unless the threshold value for the lamp current fluctuations is exceeded again before this value is reached. The detection circuit therefore uses the threshold value to identify excessive proximity to capacitive operation, reacts to this detection with an output signal, and slowly returns the output signal to its original value as soon as this detection no longer occurs.

The described output signal is limited with regard to conceivable measurement errors and is then subtracted from a desired lamp current value $I_{lamp\text{-}des}$ in the subtracter, symbolized by a minus sign. The actual value for the lamp current $I_{lamp}$, averaged by the digital averaging element is in turn subtracted from this corrected desired lamp current value. The difference between these values is integrated and multiplied by the normalization constant, denoted by $k_1$. The integrated and normalized difference between the desired lamp current value, corrected by the detection circuit, and the actual lamp current value is then totalled in the element denoted by a circle in accordance with the arrow, labeled offset, to give a value in order to adjust the operating point. This value represents a cycle duration which is in turn limited with regard to conceivable measurement errors, and is used to drive the switching transistors 6 and 7 in the half-bridge oscillator.

Overall, it may be seen that initially the PFC circuit is controlled to a constant intermediate circuit voltage having a desired value $U_{ZW\text{-}des}$. The modulation of the intermediate circuit voltage carried out by the PFC circuit influences, via the half-bridge oscillator, the lamp current which is controlled to a desired lamp current value $I_{lamp\text{-}des}$ by a second control loop. For this purpose, a simple, slow I control loop is used since only long-term drift effects need to be taken into account. This desired lamp current value is in turn corrected by a third control loop in which the detection circuit is connected, such that the threshold value of 50 mA for the lamp current amplitude modulations is not continually exceeded.

It may also be seen that the invention has only one further slow control loop, in the sense of an additional software branch, in addition to the lamp current control circuit which is provided anyway, and no additional measured value determination is required for this further control loop. Instead, the lamp current which is measured and digitized in any case is used.

If required, the described control process may be supplemented by a further control element in the lamp current control circuit, by means of which the 100 Hz modulation of the lamp current is attenuated. Instead of a simple I controller, a PI controller could be used, for example. This does not have any effect on the fact that lamp current modulations remain, even if they are only smaller ones. Even if the lamp current modulations were to be completely corrected, they could still be used for the detection, according to the invention, of the proximity to capacitive operation to the extent of using the actuating signal for the lamp current control loop to represent the fluctuations in the lamp current. The fluctuations in the lamp current would then exist to a certain extent only from the control engineering point of view and would no longer be physically present. The invention also relates to this variant. Otherwise, the current would break into the capacitive region even if the lamp current was perfectly controlled.

Otherwise, it has already been established that the intermediate circuit voltage $U_{ZW}$ in FIG. 2 or between the connection 5 and ground 4 in FIG. 1 could also be a voltage, which has been deliberately modulated, from a d.c. voltage source. This would not affect the principle of this exemplary embodiment. In this case, the PFC circuit would, however, be superfluous.

The invention thus enables a very precise matching of the operating circuit to continuous operation that, on average, is close to resonance, despite component tolerances and lamp aging processes and with little additional complexity. Should difficulties arise, in contrast to the prior art lamp operation is continued and only a certain reduction in power is undertaken as a consequence of the change in the desired current value. From the point of view of the consumer, a lamp which burns with a brightness that is scarcely perceptibly reduced is to be considered by far the more favorable solution as compared with an unserviceable lamp.

What is claimed is:

1. An operating circuit for a discharge lamp, having an oscillator circuit for generating radio-frequency supply power for a load circuit containing the discharge lamp from a variable supply power and a detection circuit for identifying the proximity to capacitive operation of the load circuit, characterized in that the detection circuit detects the magnitude of fluctuations, corresponding to the changes in the supply power, in the lamp current.

2. The operating circuit as claimed in claim 1, in which the detection circuit carries out a comparison of the magnitude of fluctuations with a predetermined threshold value.

3. The operating circuit as claimed in claim 1, which designed such that, in response to the detection circuit identifying the proximity to capacitive operation, the operation of the oscillator circuit is adapted in such a way that the proximity to capacitive operation is increased no further and the operation can be continued.

4. The operating circuit as claimed in claim 1, having a current control circuit for controlling the lamp current to a desired current value ($I_{lamp\text{-}des}$).

5. The operating circuit as claimed in claim 1, having a power control circuit for controlling the lamp power to a desired power value.

6. The operating circuit as claimed in claim 4, which is designed such that, in response to the detection circuit identifying the proximity to capacitive operation, the desired control value ($I_{lamp\text{-}des}$) is reduced.

7. The operating circuit as claimed in claim 1, having a PFC circuit which supplies the oscillator circuit with d.c. voltage power, is connected to a rectifier and is controlled to the d.c. voltage.

8. The operating circuit as claimed in claim 7, in which a microcontroller contains a positive control circuit for the oscillator circuit and for the PFC circuit.

9. The operating circuit as claimed in claim 5, which is designed such that, in response to the detection circuit identifying the proximity to capacitive operation, the desired control value ($I_{lamp\text{-}des}$) is reduced.

10. The operating circuit as claimed in claim 1, which is designed for an a.c. voltage supply power and has a rectifier for generating a d.c. voltage power.

11. An operating circuit for a discharge lamp, having an oscillator circuit for generating radio-frequency supply power for a load circuit containing the discharge lamp from a variable supply power, a detection circuit for identifying the proximity to capacitive operation of the load circuit, and a lamp control circuit for controlling the load circuit to a desired lamp value ($I_{lamp\text{-}des}$), characterized in that the detection circuit detects the magnitude of fluctuations, corresponding to the changes in the supply power, in a manipulated variable of the lamp control circuit.

12. The operating circuit as claimed in claim 11, which is designed such that, in response to the detection circuit identifying the proximity to capacitive operation, the operation of the oscillator circuit is adapted in such a way that the proximity to capacitive operation is increased no further and the operation can be continued.

13. The operating circuit as claimed in claim 11, in which the control circuit has an I control element.

* * * * *